US008578740B2

(12) United States Patent
Schneider et al.

(10) Patent No.: US 8,578,740 B2
(45) Date of Patent: Nov. 12, 2013

(54) SLIDER NEEDLE WITH IMPROVED SLIDER

(71) Applicant: Groz-Beckert KG, Albstadt (DE)

(72) Inventors: Juergen Schneider, Balingen (DE); Andreas Dietz, Kobe (JP)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 13/649,207

(22) Filed: Oct. 11, 2012

(65) Prior Publication Data

US 2013/0091901 A1 Apr. 18, 2013

(30) Foreign Application Priority Data

Oct. 12, 2011 (EP) ..... 11184917

(51) Int. Cl.
*D04B 35/06* (2006.01)

(52) U.S. Cl.
USPC ..... 66/120

(58) Field of Classification Search
USPC ..... 66/116, 120, 123
See application file for complete search history.

(56) References Cited

U.S. PATENT DOCUMENTS

| | | | | |
|---|---|---|---|---|
| 1,673,634 | A * | 6/1928 | Page | 66/13 |
| 3,584,481 | A * | 6/1971 | Hayashi | 66/120 |
| 5,937,673 | A * | 8/1999 | Shima | 66/120 |
| 6,233,977 | B1 * | 5/2001 | Schuler et al. | 66/120 |
| 6,389,848 | B1 * | 5/2002 | Kyoutani | 66/120 |
| 6,422,045 | B1 * | 7/2002 | Morita et al. | 66/120 |
| 6,568,223 | B1 * | 5/2003 | Morita | 66/120 |
| 6,904,774 | B2 * | 6/2005 | Morita | 66/120 |
| 6,915,667 | B2 * | 7/2005 | Morita et al. | 66/120 |
| 7,930,906 | B2 * | 4/2011 | Dietz et al. | 66/120 |

FOREIGN PATENT DOCUMENTS

| | | |
|---|---|---|
| EP | 1229158 A1 | 8/2002 |
| EP | 2458052 A2 | 5/2012 |

OTHER PUBLICATIONS

European Search Report and Opinion; Apln. No. 11184917.0: dated Aug. 6, 2012; 7 pgs.

* cited by examiner

*Primary Examiner* — Danny Worrell
(74) *Attorney, Agent, or Firm* — Fitch, Even, Tabin & Flannery LLP

(57) ABSTRACT

The slider (17) of an improved slider needle (10) comprises a slot guide (24), wherein the slider springs (18, 19) are provided with a dual deformation on their respective cam follower sections (29). The dual deformation is produced, for example, by a double bend and/or by an additional superficial embossing on a partial surface (34) or also by bending over a section (40) close to the edge. Due to this measure, the guiding precision of the slot guide (24) is improved and, if desired, the penetration space between the two slider springs (18, 19) is also enlarged.

21 Claims, 4 Drawing Sheets

SLIDER NEEDLE WITH IMPROVED SLIDER

RELATED APPLICATIONS

This application claims the benefit of European Patent Application No. 11184917.0 filed Oct. 12, 2011.

TECHNICAL FIELD

The invention relates to a slider needle with improved slider control.

BACKGROUND

A slider needle has been known, for example from publication EP 1 229 158 B1. This slider needle has a needle body with a slider channel that is delimited by two lateral walls. The slider that comprises two leaf springs is arranged between two lateral walls. The slider can be moved in the slider channel in longitudinal direction in order to have its catch contact the hook of the needle base body and to close the interior space of the hook. When the slider is retracted it releases the hook. Its catch is then removed from the hook. When the slider is being retracted it is frequently desired that said slider perform not only a longitudinal retracting movement but, at the same time, a descending movement. To accomplish this, the bottom of the slider channel has a ramp. In order to guide the slider down the ramp, the slider has laterally bowed cam follower sections that come into engagement with slot guides of the lateral walls. The cam follower sections have cam follower surfaces that, in doing so, move along the corresponding cams of the slot guide recess.

In addition, the laterally bowed cam follower sections of the two slider springs can form a penetration funnel into which other knitting tools may descend, for example for stitch re-hanging.

Considering the design of the slider, care must be taken that said slider will reliably descend into the slider channel, even with extremely filiform needles and at high knitting speed.

If other knitting tools are intended to penetrate the laterally bowed cam follower sections, penetration should be made as easy as possible.

Thus, the resultant object of the invention is to provide an improved slider needle, whereby the design of said slider needle is suitable, in particular, for the production of slider needles with a particularly fine division.

SUMMARY

The slider needle in accordance with various aspects of the invention has an elongated needle body with a slider channel that is delimited by two lateral walls. On its one end, the slider has two slider springs. The slider springs may be molded in one piece to a slider base body or may also be subsequently detachably or non-detachably connected with the slider shank. At least one of the two slider springs has a cam follower section that interacts with a slot guide recess provided in the adjacent lateral wall. Preferably, the other slider spring also has such a mirror-symmetrical cam follower section that also is in engagement with a slot guide recess of its associate lateral wall. In the slider needle of the invention herein, the cam follower surface provided on the cam follower section is in alignment with the guide surface of the slot guide recess.

The alignment is preferably achieved by dual or multiple bends of the cam follower section. The alignment of the cam follower surface relative to the guide surface may be accomplished with various measures. For example, it can be ensured that the cam follower surface is aligned parallel with the slot guide surface of the slot guide recess, at least relative to the cross-sectional plane of the guide body and the slider. Additionally or alternatively, the alignment of the cam follower surface relative to the guide surface may be accomplished in that the cam follower surface does not laterally extend beyond the guide surface. In this context, the cam follower surface may have the same width as, or be narrower than, the guide surface. In particular, the alignment may also consist in that the upper part of the cam follower section, said part being directly adjacent to the cam follower surface, has an orientation that is parallel to the lateral wall relative to a vertical direction perpendicular to the slider channel bottom.

In order to align the cam follower surface with the guide surface the laterally bowed cam follower section may be provided with an embossing or other imparted shaping. In particular, the cam follower section may display a reduced wall thickness in the embossed region. Embossing achieves a plastic deformation of the material of the cam follower section, in the course of which a (minimal) flow of the material can occur. As a result of this, the precise positioning of the cam follower surface can be achieved so that said surface is aligned relative to the slot guide recess as desired. The embossing may be visible as an indentation. The indentation may be provided on the side of the slider spring opposite the lateral wall (i.e., "outside") or also on the opposite side of the slider spring facing the other slider spring (i.e., "inside").

The molded indentation that is visible as an indentation is preferably provided so as to directly adjoin the cam follower surface. In doing so, the desired precision of the alignment of the cam follower surface is easily achieved.

Alternatively, the slider needle may also comprise a slider with a slider spring having a bent edge on the cam follower section. This bent edge offers a particularly wide cam follower surface, thus achieving a reliable interaction with the slot guide and the cam follower.

The slider needle of the invention herein comprises a slider having a cam follower section that is in specific alignment with the slot guide or that has a widened guide surface. Both measures have the result that the slider is reliably guided, in particular when said slider is being retracted and is descending into the slider channel. The risk that the cam follower and the guide surface of the slot guide will miss each other laterally and the slider will thus not descend or be moved out properly has been avoided. In addition, the embodiment with the additional laterally molded indentation or embossing of the cam follower section of the slider spring can create an enlarged free space between the slider springs in the cam follower section, thus facilitating the descending of penetrating tools.

BRIEF DESCRIPTION OF THE DRAWINGS

Additional details of advantageous embodiments of the invention result from the description or the claims, and from the drawings.

DETAILED DESCRIPTION

Figure 1:
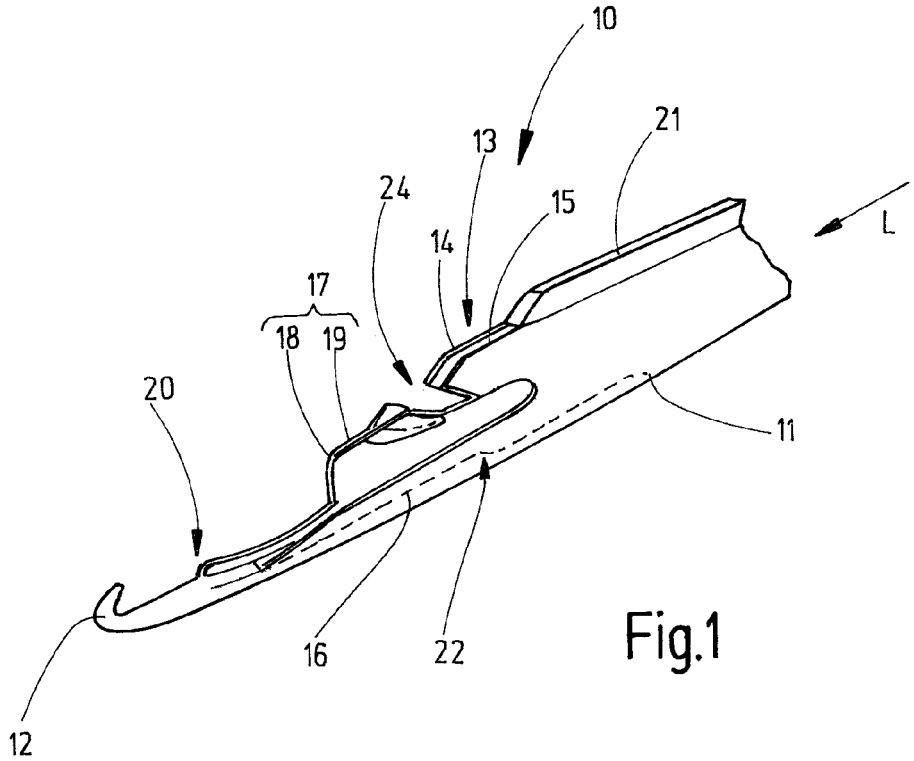
FIG. 1 a schematized perspective representation of a section, indicating the basic principle of a slider needle in accordance with the invention.

FIG. 1 shows a slider needle 10, said needle acting as the knitting needle. Said needle has an elongated needle body 11 bearing a hook 12 on one end. The slider needle can be configured for a particularly fine division.

The needle body 11 has a slider channel 13 that is delimited by two lateral walls 14, 15. The slider channel 13 extends through the needle body 11 in sliding direction L. The slider channel 13 becomes flat as it terminates near the hook 12. On the underside, said slider channel is delimited by a bottom 16 that is concealed in FIG. 1 and thus indicated in a dashed line. A slider 17 is held between the flat, preferably plane, lateral walls 14, 15, said slider comprising two slider springs 18, 19. Preferably, the slider springs 18, 19 are symmetrical relative to each other. They are flat as they abut against each other, or they abut at least partially against each other, and form a catch 20 on the end, said catch facing the hook 12. This catch can be moved—in sliding direction L—toward the hook 12 and away from said hook. At least in a few embodiments, the slider 17 can also be moved far enough for the hook 12 to be received between the slider springs 18, 19. If and to what extent this occurs depends on the knitting process carried out by the slider needle 10.

The usual driving means of a slider needle 10 prespecify the movement of the needle body 11 and/or the slider 17. These driving means are not specifically shown in the figures. For example, the needle body 10 may have one or more feet. Likewise, the slider 17 may have one or more feet. These feet interact with a cam assembly that effects a relative movement between the needle body 11 and the slider 17.

The slider channel 13 may additionally be closed at the top by a closing piece 21. This closing piece is preferably a part of the slider or the slider base body.

As has already been obvious from FIG. 1, the bottom 16 has a ramp 22 that is disposed to impart the slider 17 with a vertical movement, said movement being directed perpendicularly toward the bottom 16. To accomplish this, the slider 17, or its slider springs, have an inclined surface 23, as is obvious from FIG. 3. When the slider 17 is moved toward the hook 12, the inclined surface 23 reaches the ramp 22 at some time and continues to move along said ramp. As a result of this, the slider 17 is lifted slightly. The catch 20 that is otherwise located below the hook 12 is guided to the level of the tip of the hook 12 meeting said hook at that point.

The inclined surface 23 can effect a lifting, but not a secure, descending of the slider 17. In particular, if the slider channel 13 is soiled, for example, by abraded fiber and metal materials, oil, wax, lubricants, etc., there is the risk that the slider 17 will not reliably descend. A slot guide 24 is provided for again lowering the slider 17 in a targeted manner during retraction. The slot guide 24 shown in FIG. 1 is shown in greater detail in FIG. 2 with the aid of the slider spring 19 and the lateral wall 15. The slot guide 24 comprises a slot guide recess 25 in the lateral wall 15, said slot guide recess having a guide surface 26. The guide surface 26 is a surface that is oriented so as to be inclined relative to the bottom 16, i.e., said guide surface is aligned approximately parallel with the ramp 22. It terminates in a mouth-like recess that opens toward the hook 12. The guide surface 26 is adjoined by a preferably straight narrow surface 27 that is disposed to hold the slider 17 in deep position.

Beside the slider spring 19, the slot guide 24 also comprises a cam follower 28 that is configured as a laterally bowed cam follower section 29 of the slider spring 19. At a bending line 30, the cam follower section terminates in the slider spring 19. The lateral bowing of the slider spring 19 on the cam follower section 29 is obvious from FIG. 3. In doing so, the lateral bowing is large enough to enable the cam follower section 29 to extend into the slot guide recess 25 when the slider spring 17 is in retracted position. When the slider spring 17 is being retracted, an inclined cam follower surface 31 of the cam follower section 29 initially moves along the inclined guide surface 26, whereupon an upper straight edge 32 of the cam follower section 29 ends up under the narrow surface 27.

In at least in one preferred embodiment, the slider springs 18, 19 are symmetrical relative to each other. The description of the slot guide recess 25 and the cam follower section 29 hereinabove thus applies, analogously, to the slider spring 18 and the lateral wall 14. Consequently, analogous structures of the slider spring 18 are identified with the same reference sign.

Figure 2:
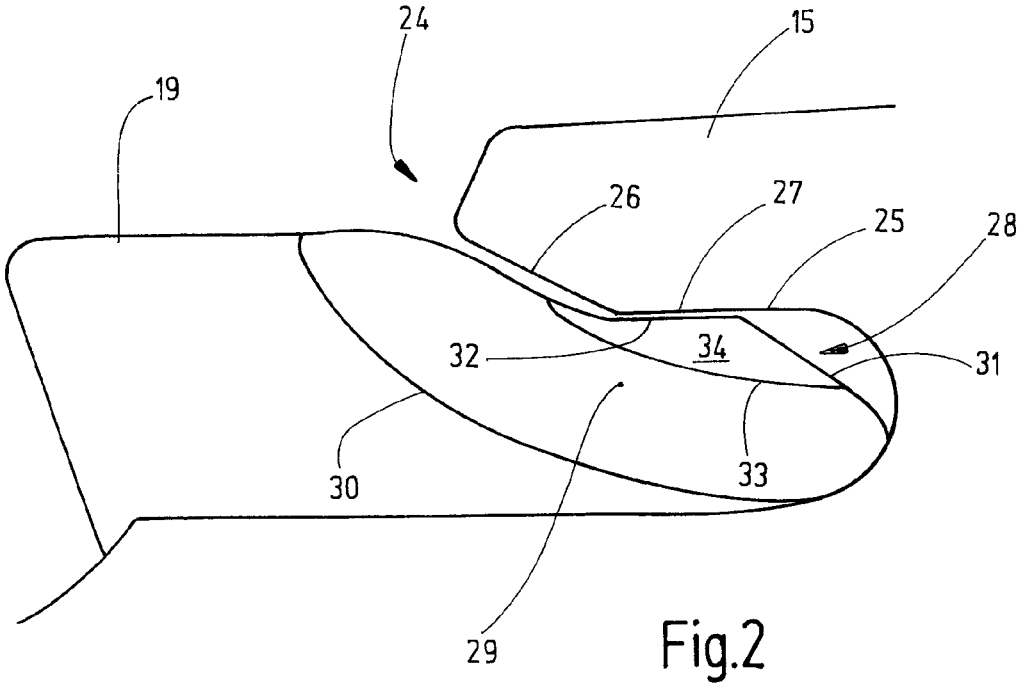
FIG. 2 a side view of a detail of the slider needle as in FIG. 1.
Figure 3:
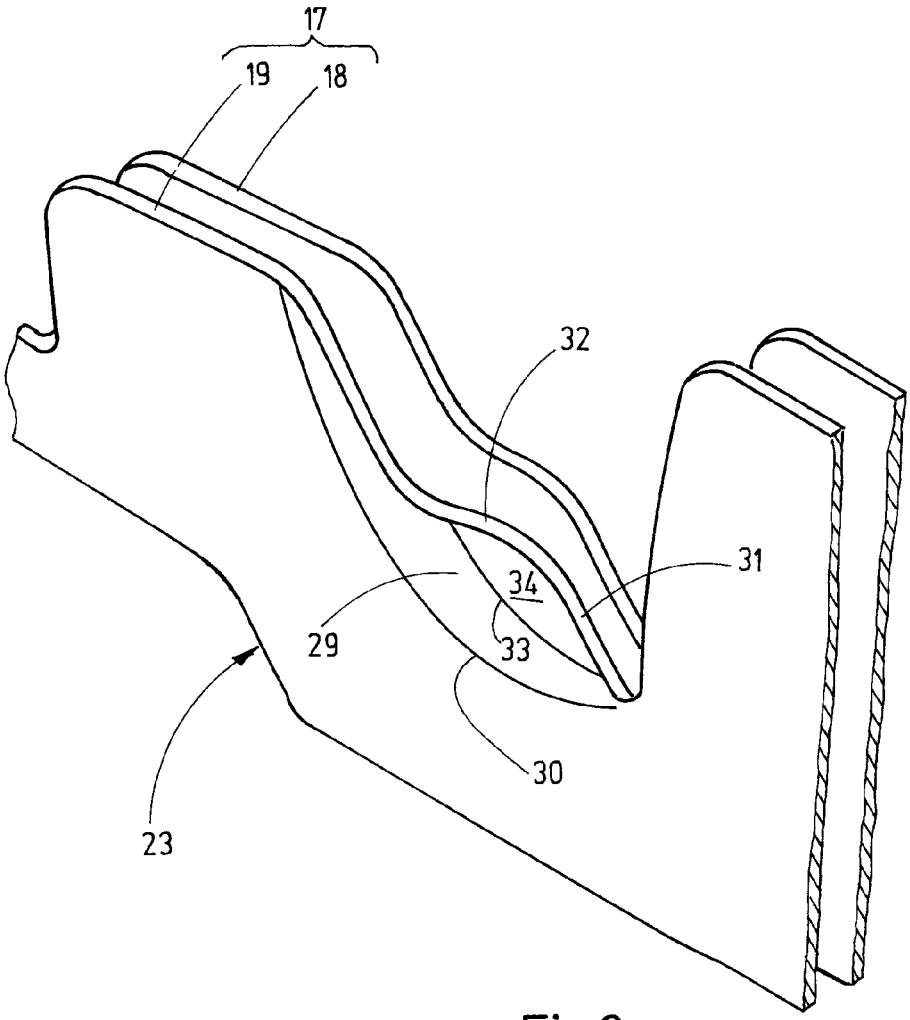
FIG. 3 a perspective representation of a section of the slider of the slider needle as in FIG. 1.
Figure 4:
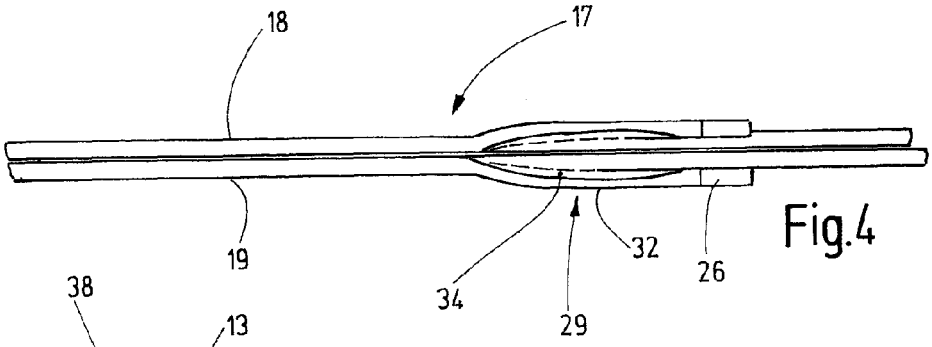
FIG. 4 a plan view of a schematized section of the slider springs of the slider needle as in FIG. 1.
Figure 5:
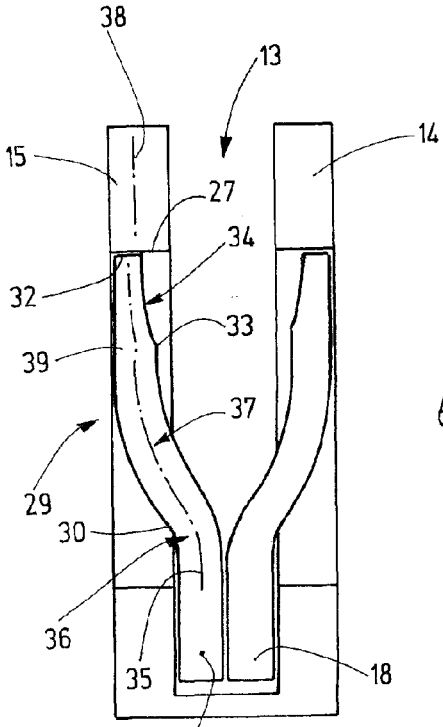
FIG. 5 a vertical section of an embodiment of a slider needle in accordance with the invention.
Figure 6:
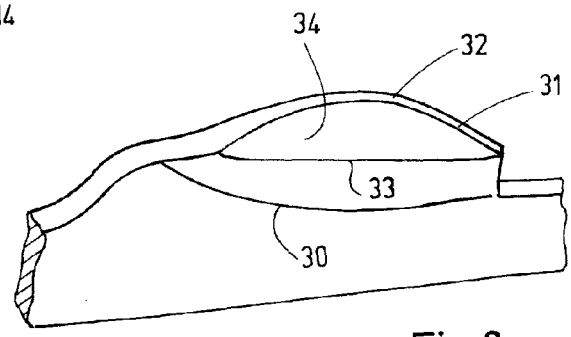
FIG. 6 a perspective representation of a section of a slider spring of the slider needle as in FIG. 5.

As is shown by FIGS. 2 and 3, the slider spring 19 is bent twice on its cam follower section 29. The slider spring 19 has a bend at the bending line 30, said bend causing the cam follower section 29 to laterally project beyond the flat side of the bending spring 19. A second deformation begins at a line 33, said deformation affecting a partial region 34 of the cam follower section 29. The partial region 34 may represent a second bend. In this case, the line 33 is a bending line. However, this may also be molded indentation that has been produced, for example, during an embossing step. In this case, the line 33 represents a sharp or rounded edge. In the exemplary embodiment of FIGS. 2 and 3, the molded indentation is located on the outside of the bending spring 17. The result of this is that the cam follower surface 31 and/or the edge 32 are slightly narrower—a least along a part of their length—than the remainder of the slider spring 19. In other words, the material thickness may be reduced in the partial region 34. The reduction of the thickness can be visible mostly on the outside, as is being suggested by FIGS. 2 and 3. Additionally or alternatively, the thickness reduction may also be provided on the inside side facing the slider spring 18, as is illustrated by FIGS. 4 through 6. In FIG. 5, a center line 35 has been drawn in a chain line for the purpose of clarification, said center line identifying the bend of the slider spring 19. As is obvious, a first bend 36 is provided on the bending line 30. Beginning at that point, the center line 35 branches out of the orientation parallel to the lateral wall 15 into an orientation that is at an acute angle relative to the lateral wall 15. At a bending point, or also gradually, the center line 35 may terminate in another angle in a second bend 37. For example, in this instance, the center line 35 may again extend parallel to the lateral wall. To make this better understandable, the center of the lateral wall 15 is marked by a center line 38, said center line being drawn as a chain line.

If the cam follower section 29 is provided in the partial region 34 adjacent to the edge 32 with an embossing or molded indentation, the center line 35 displays an additional, in this instance third, bend 39 at the start of this molded indentation. Thus, the center line 35 can be offset at the edge 32 relative to the center line 38. However, in a preferred embodiment, the edge 32 at least does not laterally project beyond the narrow surface 27.

During operation, the slider 17 is moved in a reciprocating manner. In doing so, when the slider 17 is being retracted, the cam follower surfaces 31 of the two slider springs 18, 19 come into contact with the narrow surfaces 27 of the slot guide recesses 25. Due to the inclined position of the surfaces, the slider 17 is displaced downward in the direction toward the bottom 16 when said slider is retracted further. Due to the alignment of the edge 32 and the cam follower surface 31 relative to the narrow surface 27 and the guide surface 26, it is ensured that the surfaces move on each other in a precise manner. The cam follower surface 31 is prevented from moving past the guide surface 26 or from sliding off said guide surface. In other words, even in the case of particularly filiform needle designs and at high operating speed, the full functionality of the slot guide 24 is ensured, even when the slider needle is soiled.

Figure 7:
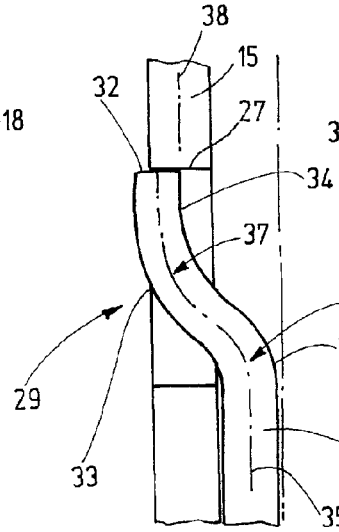
FIG. 7 a vertical section of a section of an alternative embodiment of the slider needle.

As is shown in FIG. 7, the sections of the cam follower section 29 may also have a more or less uniform thicknesses. However, the center line 35 is provided with two bends 36, 37, so that said center line is again oriented parallel to the center line 38 in the partial region 34. Even if the edge 32 and/or the cam follower surface 31 extending laterally somewhat next to the narrow surface 27, i.e., extend beyond said narrow surface, any sliding-off is reliably prevented.

Figure 8:
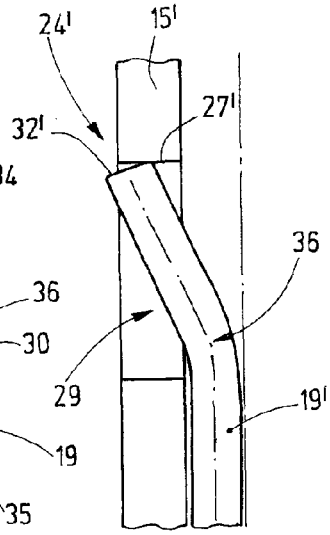
FIG. 8 a vertical section of a section of a prior-art slider needle.

The relationships are usually different when the slider spring 19' has only a single bend 36, as is common in prior art as depicted in FIG. 8. In this case, the edge 32' is not in alignment with the narrow surface 27'. Rather, they extend at an acute angle with respect to each other. In high-speed mode, the slider spring 19' can slip off the narrow surface 27' of the lateral wall 15', so that the full functionality of the slot guide 24' in accordance with prior art cannot be ensured.

As can be seen, the bends 36, 37 (and, if necessary, bend 39) are matched in such a manner that the edge 32 and the narrow surface 37 are aligned with each other in a matching manner. For example, this is obvious from the fact that the part of the center line 35 adjacent the edge 32 is oriented parallel (or substantially parallel) to the center line 38. In the exemplary embodiment of FIG. 7, the bends 36, 37 are preferably identically equal, but they have an inverse mathematical sign. The bends 36, 37 need not necessarily represent sharp bending edges. They may also be distributed over a larger portion of the slider spring 19 or the partial region 34.

Figure 9:
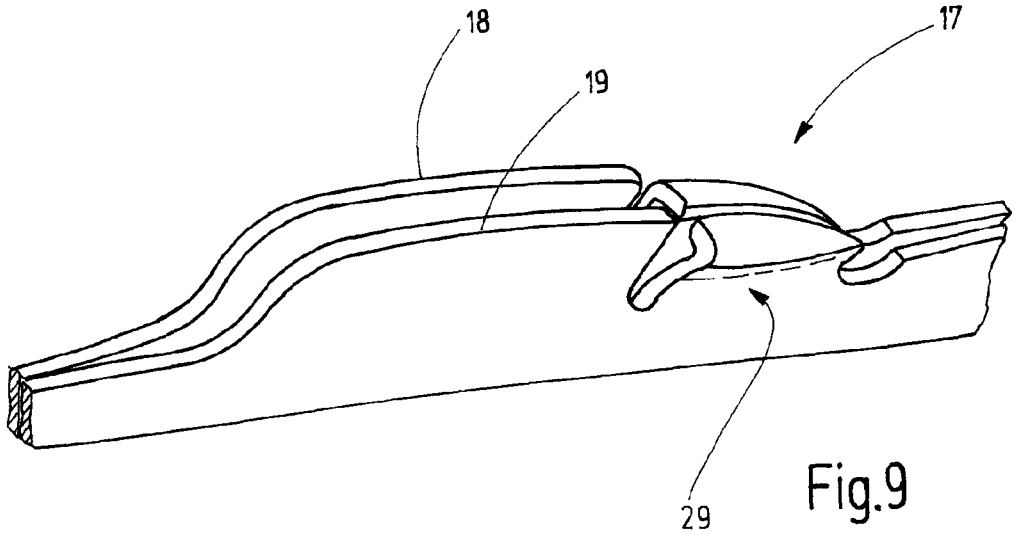
FIG. 9 a perspective representation of a section of an alternative embodiment of a slider of a slider needle in accordance with the invention.
Figure 10:
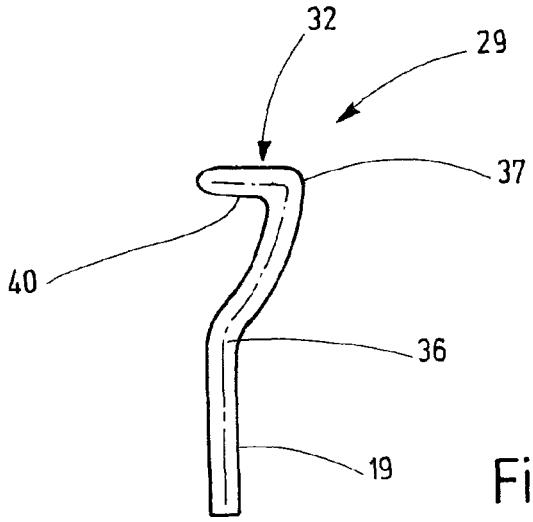
FIG. 10 a cross-section through a slider spring of the slider as in FIG. 9.

FIG. 9 shows a greatly modified embodiment of the slider 17 of the slider needle 10 of the invention herein. Again, the slider springs 18, 19 are configured so as to be minor-symmetrical. Consequently, the description hereinafter equally applies to both slider springs 18, 19.

Again, the cam follower section 29 is bent out of the plane of the slider spring 19. However, on its upper edge, said section is preferably angled inward toward the other slider spring 18. As a result of this, again two bends 36, 37 and a particularly wide edge 32 are formed. This "edge" is formed by an inward-bent section 40 of a portion of the cam follower section 29. Even in particularly fast operating modes there is no risk, whatsoever, for the edge 32 to potentially move past the corresponding guide surface 26 or narrow surface 27. Also, in this embodiment of the invention that does not enable any penetration of another knitting tool from the top, the operation is, again, clearly more reliable than in the conventional design depicted in FIG. 8.

The slider 17 of an improved slider needle 10 comprises a slot guide 24, wherein the slider springs 18, 19 are provided with a dual deformation on their respective cam follower sections 29. The dual deformation is produced, for example, by a double bend and/or by an additional superficial embossing on a partial surface 34 or also by bending over a section 40 close to the edge. Due to this measure, the guiding precision of the slot guide 24 is improved and, if desired, the penetration space between the two slider springs 18, 19 is also enlarged.

LIST OF REFERENCE SIGNS

10 Slider needle
11 Needle body
12 Hook
13 Slider channel
14 Lateral wall
15, 15' Lateral wall
16 Bottom
17 Slider
18 Slider spring
19, 19' Slider spring
20 Catch
21 Closing piece
22 Ramp
23 Inclined surface
24, 24' Slot guide
25 Slot guide recess
26 Guide surface
27, 27' Narrow surface
28 Cam follower
29 Cam follower section
30 Bending line
31 Cam follower surface
32, 32' Edge
33 Line
34 Partial region
35 Center line
36 First bend
37 Second bend
38 Center line
39 Third bend
40 Section
L Sliding direction

What is claimed:

1. Slider needle comprising:

an elongated needle body with two oppositely located lateral walls and having a slider channel that is delimited by a bottom, a slider that is arranged in the slider channel to slide along a sliding direction (L), and that comprises two flat slider springs, whereby at least one of the lateral walls has a slot guide recess with a guide surface, whereby the slider spring, at least in a retracted state of the lateral wall, has a laterally bowed cam follower section with a cam follower surface, said cam follower section being associated with the slot guide recess, and whereby the cam follower section has two or more bends in a cutting plane, wherein the sliding direction (L) is perpendicular to the cutting plane.

2. The slider needle as in claim 1, characterized in that the cam follower surface and the guide surface are aligned parallel with each other in order to center them relative to each other in a cutting plane, whereby the sliding direction (L) is perpendicular to said cutting plane.

3. The slider needle as in claim 1, characterized in that the cam follower surface and the guide surface are aligned fully overlapping each other in order to center them relative to each other in a cutting plane, whereby the sliding direction (L) is perpendicular to said cutting plane.

4. The slider needle as in claim 1 further comprising a partial region of the laterally bowed cam follower section of the slider spring defined by a deformation adjacent to the cam follower surface and oriented generally parallel with the lateral wall.

5. The slider needle as in claim 1, characterized in that the laterally bowed cam follower section of the slider spring is provided with a molded indentation.

6. The slider needle as in claim 5, characterized in that the molded indentation is provided on the side of the slider spring, said side facing the other slider spring.

7. The slider needle as in claim 5, characterized in that the molded indentation is provided on the side of the slider spring, said side facing away from the other slider spring.

8. The slider needle as in claim 1, characterized in that the slider spring has a reduced wall thickness in at least a portion of the bowed cam follower section.

9. The slider needle as in claim 5, characterized in that the molded indentation is adjacent to the cam follower surface.

10. The slider needle as in claim 1, characterized in that the lateral cam follower section is separated from the slider spring by at least one recess.

11. The slider needle as in claim 1, characterized in that the slider spring has a thickness that matches the thickness of the lateral wall.

12. The slider needle as in claim 1, characterized in that the cam follower section has a thickness that matches the thickness of the lateral wall.

13. The slider needle as in claim 1, characterized in that the cam follower section has a bent-over section where the cam follower surface is provided.

14. The slider needle as in claim 13, characterized in that a width of the cam follower surface is greater than wall thickness of the lateral wall.

15. Slider needle comprising:

an elongated needle body with two oppositely located lateral walls and having a slider channel that is delimited by a bottom, a slider that is arranged in the slider channel to slide along a sliding direction (L), and that comprises two flat slider springs, whereby at least one of the lateral walls has a slot guide recess with a guide surface, whereby the slider spring, at least in a retracted state of the lateral wall, has a laterally bowed cam follower section with a cam follower surface, said cam follower section being associated with the slot guide recess, and whereby the cam follower section has two or more bends such that the cam follower surface is in alignment with the guide surface of the slot guide recess.

16. The slider needle as in claim 15 further comprising a partial region of the laterally bowed cam follower section of the slider spring defined by a deformation adjacent to the cam follower surface and oriented generally parallel with the lateral wall.

17. The slider needle as in claim 15, characterized in that the laterally bowed cam follower section of the slider spring is provided with a molded indentation.

18. The slider needle as in claim 15, characterized in that the slider spring has a reduced wall thickness in at least a portion of the bowed cam follower section.

19. The slider needle as in claim 15, characterized in that the slider spring has a thickness that matches the thickness of the lateral wall.

20. The slider needle as in claim 15, characterized in that the cam follower section has a thickness that matches the thickness of the lateral wall.

21. The slider needle as in claim 15, characterized in that the cam follower section has a bent-over section where the cam follower surface is provided.

* * * * *